United States Patent [19]

Powell

[11] Patent Number: 4,470,631

[45] Date of Patent: Sep. 11, 1984

[54] SEATING STRUCTURE

[76] Inventor: Alfred J. Powell, 103-B Jamestown Dr., Mount Lebanon, Pa. 15216

[21] Appl. No.: 326,943

[22] Filed: Dec. 3, 1981

[51] Int. Cl.[3] ..... A47C 7/62

[52] U.S. Cl. ..... 297/217; 5/2 R; 297/184; 297/330

[58] Field of Search ..... 297/217, 330, 184; 135/96; 5/2 R

[56] References Cited

U.S. PATENT DOCUMENTS

| | | | |
|---|---|---|---|
| 2,286,372 | 6/1942 | Page | 297/217 |
| 3,179,466 | 4/1965 | Garrett | 297/61 X |
| 3,628,829 | 12/1971 | Heilig | 297/217 |
| 3,762,767 | 10/1973 | Powell | 297/184 X |
| 3,856,346 | 12/1974 | Herman | 297/61 |
| 3,865,430 | 2/1975 | Tanus | 297/217 |
| 4,379,588 | 4/1983 | Speice | 297/217 |

FOREIGN PATENT DOCUMENTS

| | | | |
|---|---|---|---|
| 1229790 | 4/1971 | United Kingdom | 297/184 |

*Primary Examiner*—James T. McCall

*Attorney, Agent, or Firm*—Webb, Burden, Robinson & Webb

[57] ABSTRACT

An enclosed seating structure comprises a plurality of trapezoidal faces forming an enclosure. The enclosure has a small horizontal base, a widened midsection and a small ceiling. The enclosure defines an opening extending substantially from the base to the ceiling. A seat is pivotally mounted on an axle that is secured across the opening. The seat extends through said opening. Automatic means position the seat in one position substantially blocking the opening, in a reclining position being substantially horizontal and in positions therebetween.

14 Claims, 17 Drawing Figures

SEATING STRUCTURE

DESCRIPTION

1. Technical Field

The invention disclosed herein is an improvement over the invention disclosed in my herein referenced patent. While the concept of a seating structure to enable an individual to seek refuge from noisy and bothersome environs has attracted considerable attention, there has remained a need to provide an easily constructed, light-weight, enclosed seating structure that easily fits into a room or boat cabin. Moreover, the enjoyment derived from such a seating structure is enhanced if it can be easily entered and exited by persons of all sizes and including those without particular agility. The seating structure is not only for individual use. For example, it can be the center of focus of a lively party with individuals taking turns in the seating structure, so long as those desiring to use the seating structure can gracefully enter and exit the seating structure.

According to this invention, there is provided an enclosed seating structure that has the main advantage of my earlier patented environmental chair and in addition, it is of light-weight construction, it is compact for fitting into small rooms and cabins and it is easily entered and exited.

2. Background Art

This invention is related to my earlier U.S. Pat. No. 3,762,767 entitled "Environmental Chair."

3. Summary of the Invention

Briefly according to this invention, there is provided an enclosure which is comprised of a plurality of trapezoidal faces. The enclosure has a small horizontal base, a widened midsection and a small ceiling. The enclosure has an opening extending substantially from base to ceiling. A seat is pivotally mounted on an axle that is secured across said opening. The seat is thus positioned in the enclosure with the leg rest portion thereof extending outside the enclosure. Automatic powered means are provided for positioning the seat with the back rest thereof in a near upright position substantially blocking the opening in which position one can ease back into the seat without removing one's feet from the floor. The automatic means also positions the seat in a reclining position carrying its occupant into the enclosure. It is preferred that the automatic means is remotely controlled from a hand held module without wire connections to the seat as by an ultrasonic transmitter.

Typically, the automatic means comprises an extensible device. The extensible device is secured at one end to the base of the enclosure and through necessary linkages to the seat such that as the extensible device is extended the seat rotates to the upright position.

Preferably, the seating structure has an arm and head rest frame separate from the seat, said frame being pivotally mounted to the side walls of the enclosure. The arm and head rest frame is arranged not to bind with the seat at least when the arm and head rest is rotated back from said opening.

DETAILED DESCRIPTION

Figure 1:
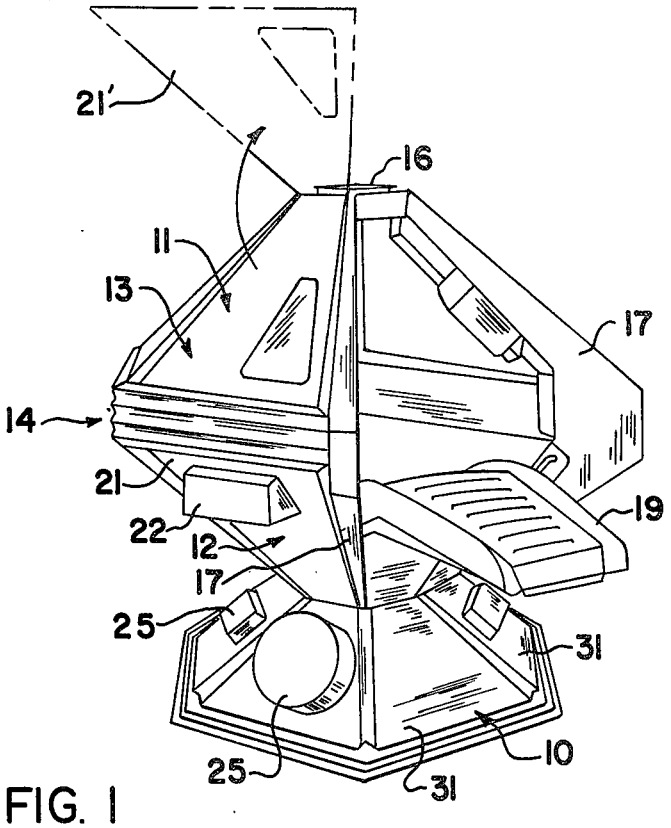
FIGS. 1 to 4 are perspective views illustrating the general structure of a seating structure according to this invention.
Figure 2:
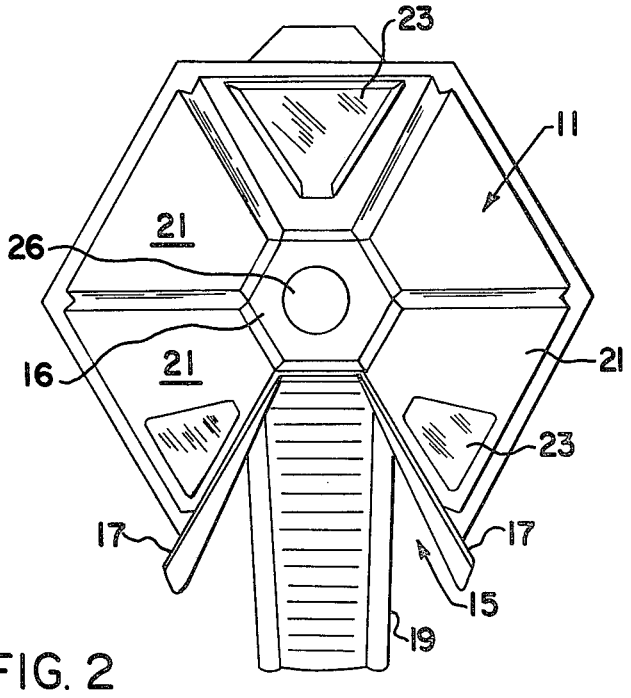

Referring now to FIGS. 1 to 4, the enclosed seating structure according to this invention comprises a base section defined by a base weldment or like structure 10 which rests upoon the floor or deck. Pivotally mounted to the base section for at least partial rotation about a generally vertical axis is an enclosure 11. The enclosure is comprised of a middle weldment or like structure 12, a top weldment or like weldment 13 and a spacer 14. In the preferred embodiment illustrated, the top 13 and middle 12 weldments comprise frustrumated pyramids formed of a plurality of trapezoidal frames.

Figure 3:
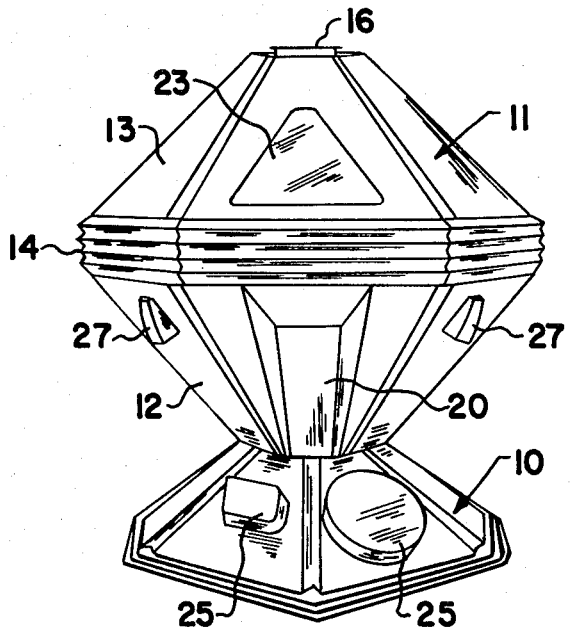
Figure 4:
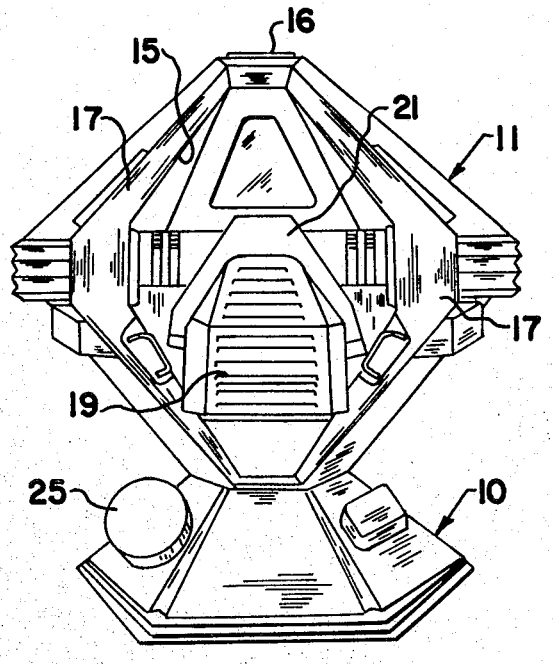

The enclosure 11 has an opening 15 therein extending from about the bottom of the enclosure to the ceiling 16 of the enclosure. The opening 15 is framed by a nose weldment 17. Mounted in the nose weldment (not visible in FIGS. 1 to 4) is an axle that has a generally horizontal axis. Mounted for rotation upon axle is a seat 19. An automatic mechanism adjusts the angular position of the seat as will be explained hereafter. An enclosure 20 for a portion of the automatic mechanism is seen in FIG. 3.

A head and arm rest 24 (see FIG. 4) is pivotally mounted for rotation about a generally horizontal axis. The head and arm rest is mounted to the interior of the enclosure 11 and is arranged, at least in one position, not to engage the seat 19.

The panels attached to the frame may be provided with receptacles 22 (see FIG. 1) for receiving apparatus such as radios, phonographs, and tape players, televisions, computers, etc. The panels may also have windows 23 therein and the panels may be mounted to rotate away from the frame for providing quick access to the interior of the enclosure by one standing along side. (See the alternate position of panel 21' in FIG. 1).

For external sound, sound speakers 25 may be mounted in the panels in the base 10. For maintaining fresh air within the enclosure, in the ceiling is mounted an intake fan 26. Additional air circulation is provided by exhaust fans 27 mounted in the panels of the enclosure.

Figure 5:
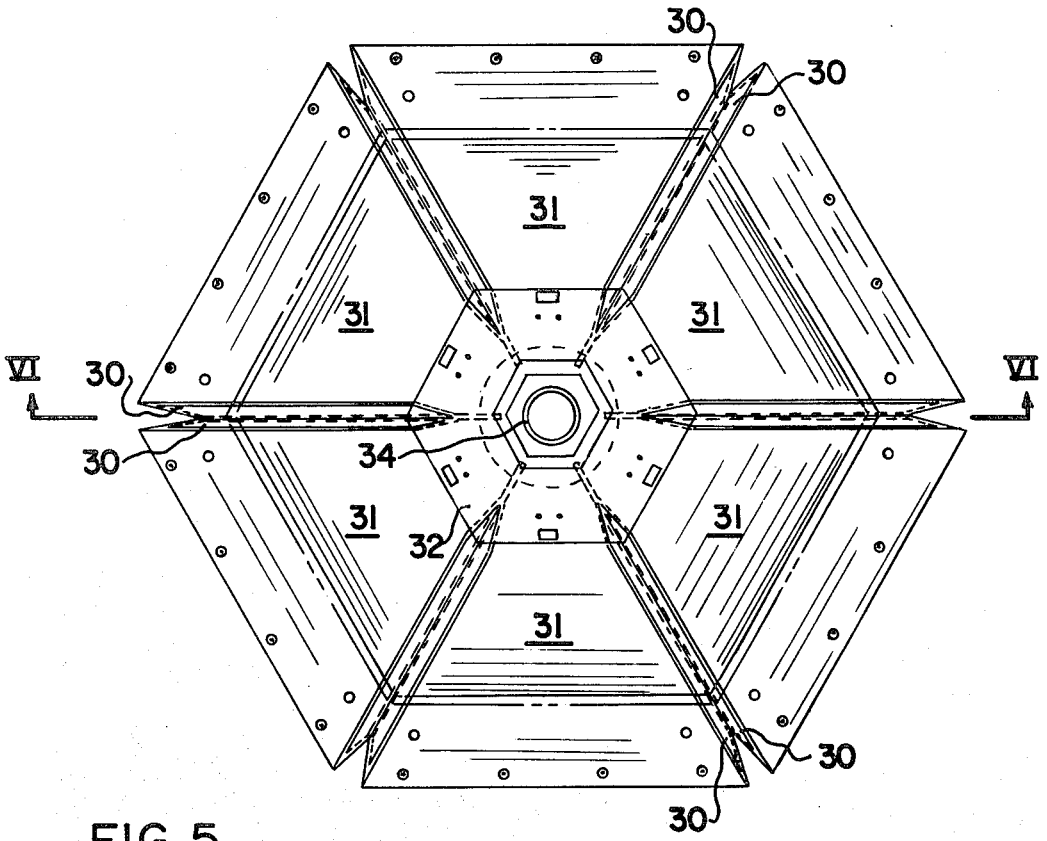
FIG. 5 is a top view of the base weldment.
Figure 6:
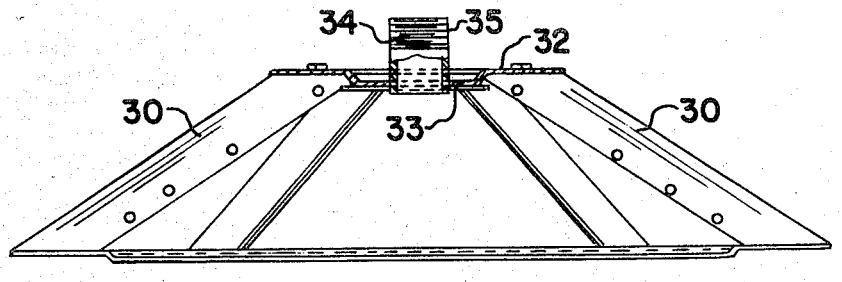
FIG. 6 is a side section along lines V—V of FIG. 5 of the base weldment.

Referring now to FIGS. 5 and 6, the base weldment is shown in detail. The base weldment comprises six trapezoidal frames 30 welded together edge-to-edge. Each trapezoidal frame has a base member, two side members and a top member. The top and base members are generally parallel and normally horizontal. The side members are folded along their long axis and have one face that is in a vertical plane with the vertical faces of each side member of a trapezoidal frame being 60° apart in the case of a base weldment comprised of six trapezoidal frames. The preferred material of construction for the frames is aluminum. The preferred means of joining the frame members is by welding.

Panels 31 (See FIG. 1) are releasably fastened to the base frames. The base weldments support a top plate 32 which is welded to center plate 33 which in turn is welded to a center cylinder 34. The cylinder 34 has external threads 35, the function of which is explained hereafter. The cavity within the base is used to contain control equipment for the seating structure such as remotely actuatable lamp and appliance modules that receive control signals on the AC power lines they control, a digital remote control receiver, DC power supplies, color translators (for operation of the mood lights), power amplifiers for the servo sound system, etc. To the extent that wire communication between the base and the enclosure is required, they may be passed through the center cylinder 34.

Figure 7:
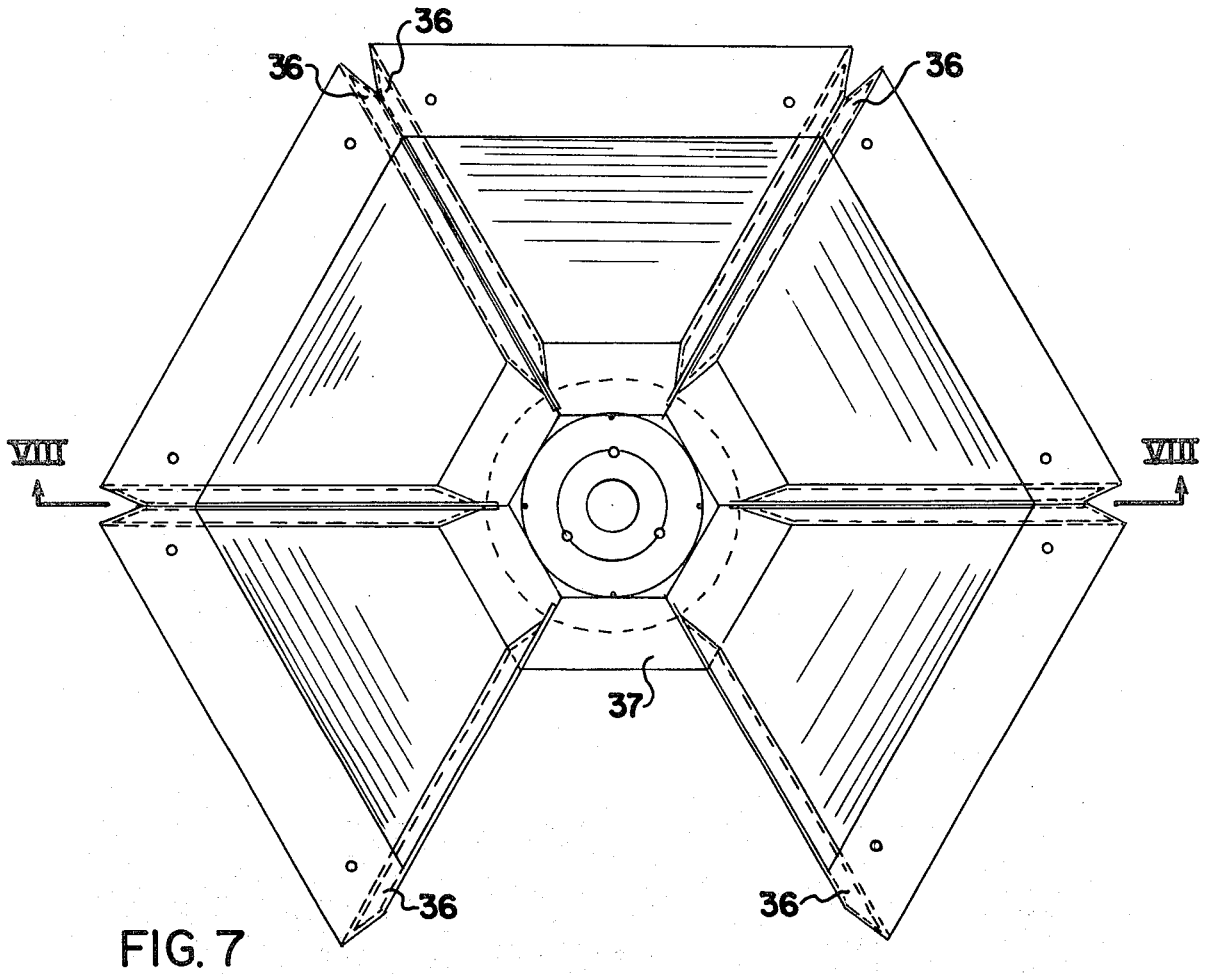
FIG. 7 is a top view of the middle weldment.
Figure 8:
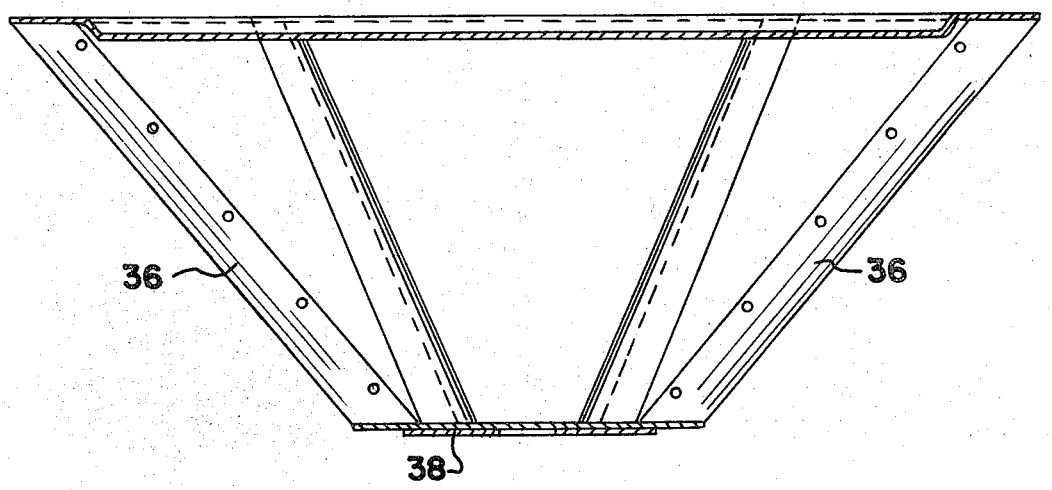
FIG. 8 is a side section taken along lines VIII—VIII of FIG. 7 of the middle weldment.

Referring now to FIGS. 7 and 8, the middle weldment resembles the base weldment but it is inverted and with only five trapezoidal frame sections 36 joined edge-to-edge. One trapezoidal section necessary to complete the enclosure is omitted to provide for an opening. A spacer 37 is used in place of the omitted trapezoidal frame. Secured to the bottom of the five trapezoidal frame sections is a bearing plate 38.

Figure 9:
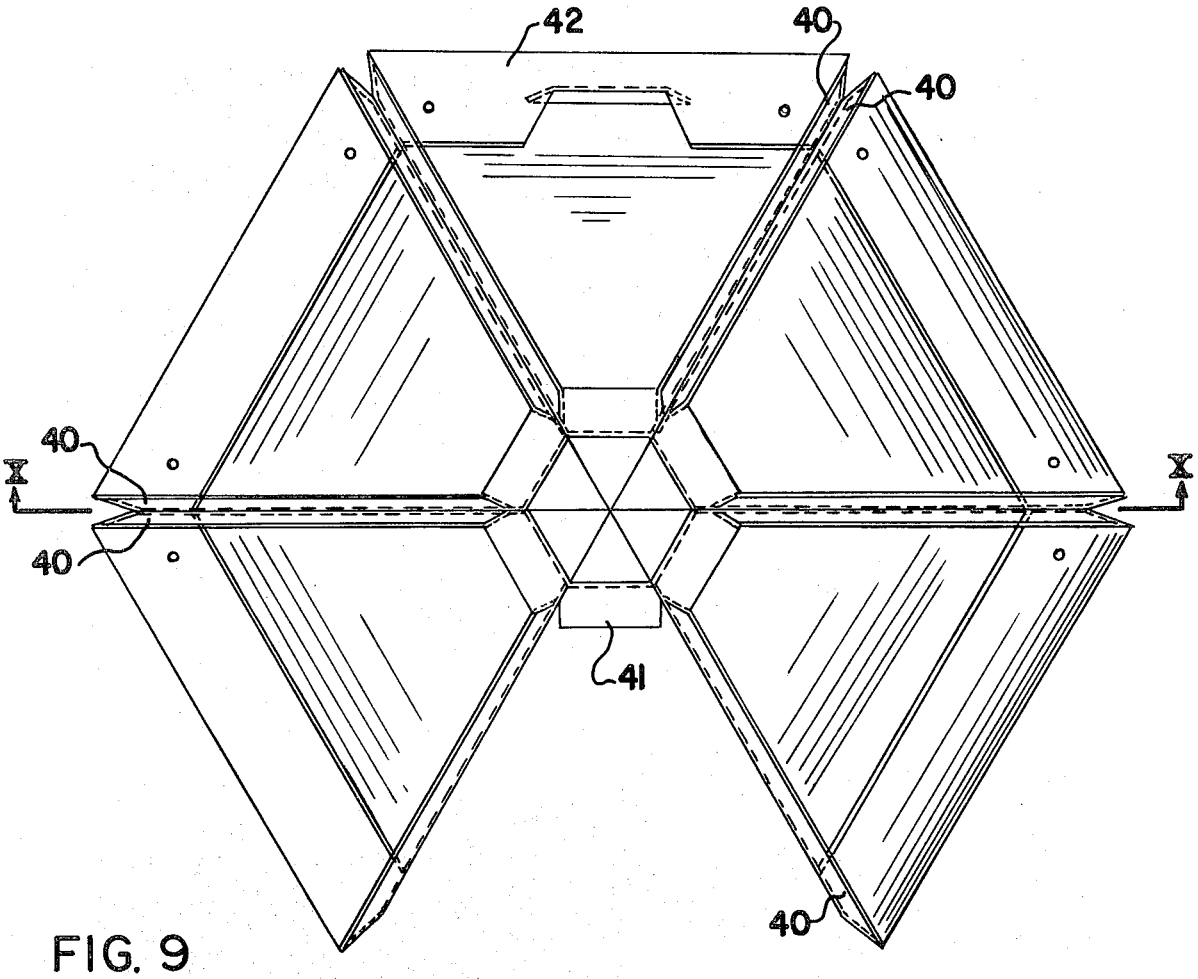
FIG. 9 is a top view of the top weldment.
Figure 10:
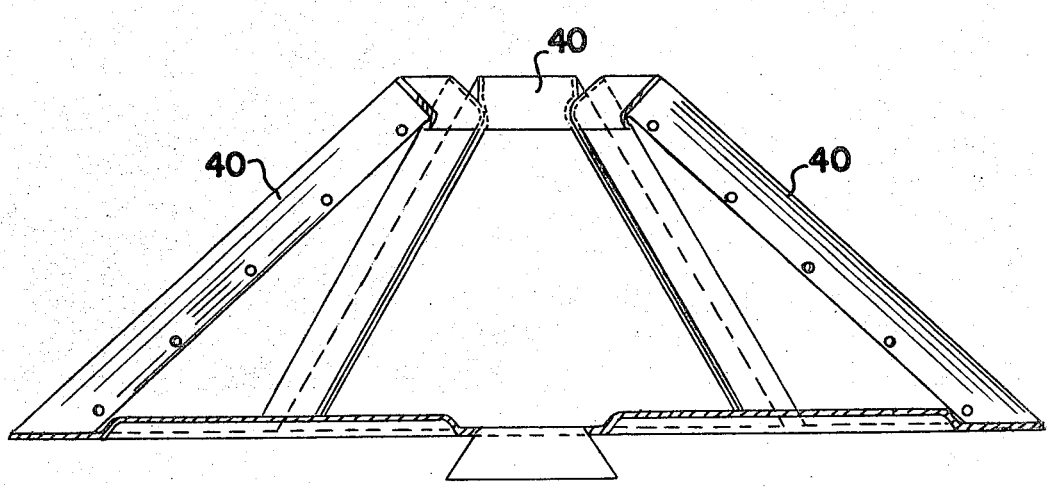
FIG. 10 is a section taken along lines X—X of FIG. 9 of the top weldment.

Referring to FIGS. 9 and 10, the top weldment resembles the base weldment with only five trapezoidal frame sections 40 joined edge-to-edge. A spacer plate 41 is used in place of the omitted trapezoidal frame section. The trapezoidal frame section opposite the omitted section is unique in having its sill plate 42 cut back and folded under to accommodate the head rest to be described.

Figure 11:
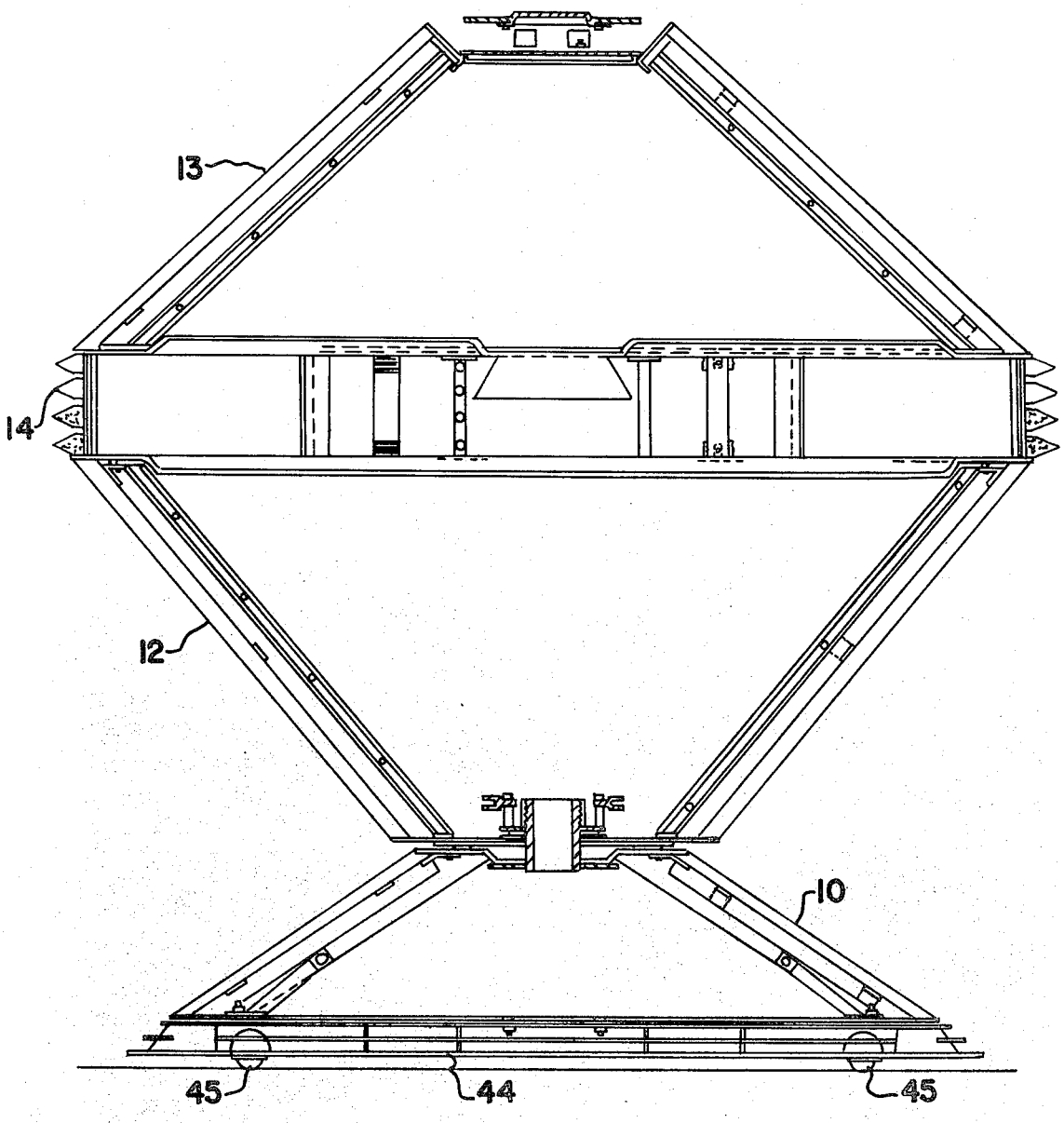
FIG. 11 is a section through the assembled enclosure.

FIG. 11 illustrates how the base weldment 10 and middle weldment 12 and top weldment 13 are assembled together with spacer 14. The spacer 14 is simply a five sided decorative structure. According to preferred embodiments of this invention, a plurality of decorative lights are mounted within the spacer section and are individually controllable on and off to thus be controlled by a digital circuit which generates decorative lighting patterns.

Figure 11A:
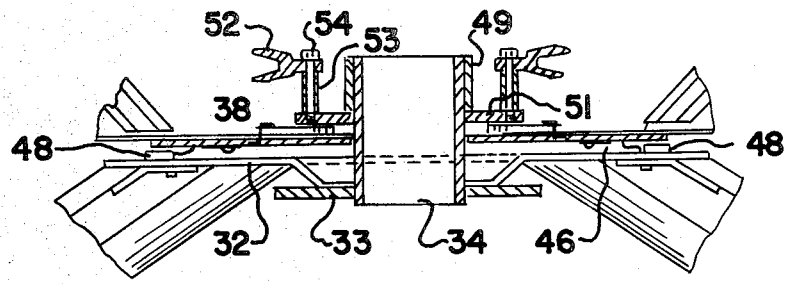
FIG. 11A is a blown-up portion of FIG. 11 detailing the thrust bearing between the base weldment and the middle weldment.

FIG. 11 further illustrates how the base is mounted to a spoiler weldment 44. The base weldment 10 supports a plurality of casters 45 enabling easy positioning of the seating structure over the floor or deck upon which it rests. FIG. 11A shows in detail the pivotal connection between the base weldment and the middle weldment. As already explained, the base weldment has a horizontal top plate 32 and center plate 33 that supports center cylinder 34. The center cylinder has external threads at the upper end. Bearing plate 38 supports the middle weldment. The bearing plate 38 has a central opening (see FIG. 7) that slides over the central cylinder. Positioned between the bearing plate 38 and the top plate 32 is a lazy susan bearing 46. This bearing is bolted to the bottom of the bearing plate 38 and is axially positioned relative to the top plate 32 by stops 48 welded to the top plate.

A cylindrical collar 49 has internal threads that mate with the external threads on the central cylinder. The collar 49 has a radial flange 51 secured at the lower axial end thereof. The bottom face of the radial flange 51 becomes adjacent to the top face of the bearing plate 38 when it is rotated into place over the center cylinder. Bearings, for example, washer bearings and needle bearings are positioned between the adjacent faces. The collar 49 thus holds down the enclosure to the base. Attached to the radial flange 51 is a sleeve or sprocket 52 held in place by spacer 53 and bolts 54. The sleeve or sprocket is used in the automatic rotation of the enclosure about its vertical axis. A motor (not shown) is fixed to the noise weldment relative to the top of the bearing plate 38 and a belt or chain connects the motor to the sleeve or sprocket. When the motor turns the enclosure is pulled about its vertical axis, physical stops as well as limit switches prevent the enclosure from rotating more than 360° in either direction.

Figure 13:
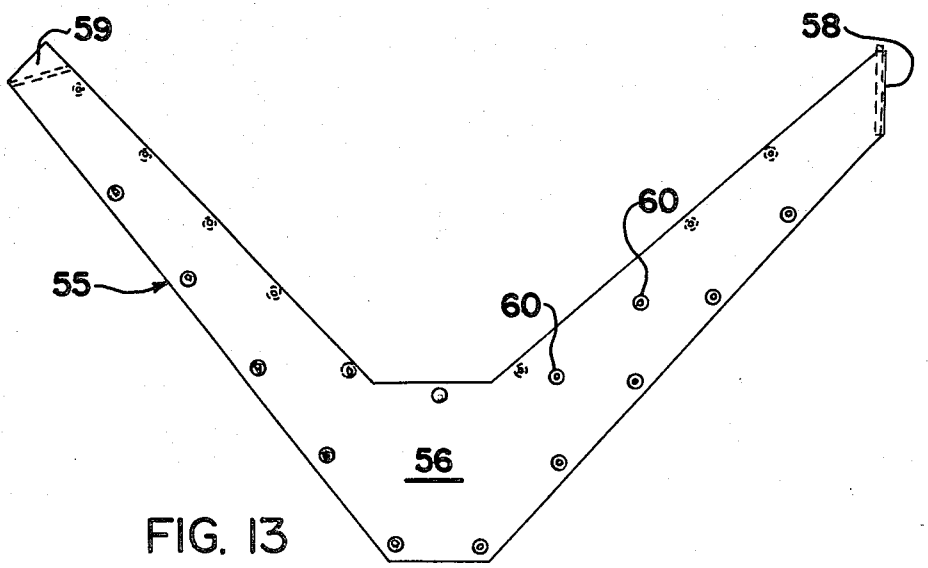
FIG. 13 is a side view of the nose weldment.
Figure 12:
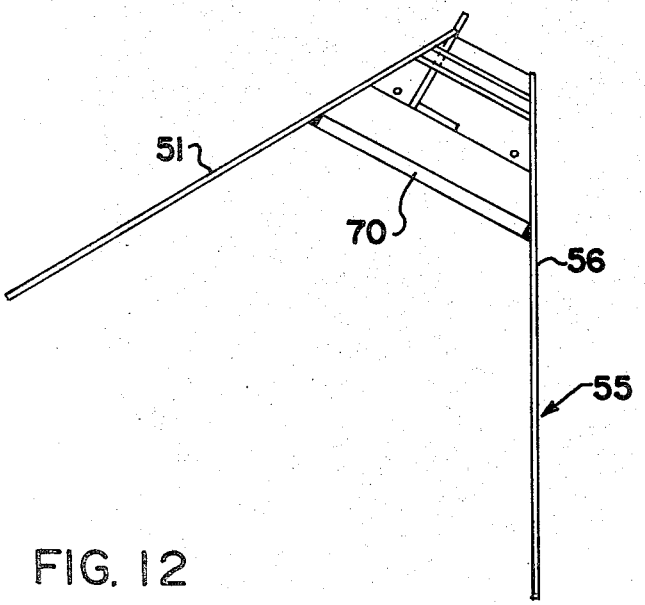
FIG. 12 is a top view of the nose weldment.

Referring now to FIGS. 12 and 13, the opening is supported by a nose frame that serves several functions. It ties the top weldment, middle weldment and spacer together and supports the edges thereof adjacent to the opening in their proper location. Moreover, it provides a strong location where an axle 70 for the seat may be fixed. The frame comprises two side plates 56, 57 having a base connector plate 58 and a top connector plate 59. The surfaces of the nose frame may be decoratively upholstered.

In addition to supporting the axle for the seat, the nose frame also enables the attachment of handles 60 to facilitate entry and exit from the seat. It also contains rotation motor mount.

Figure 14:
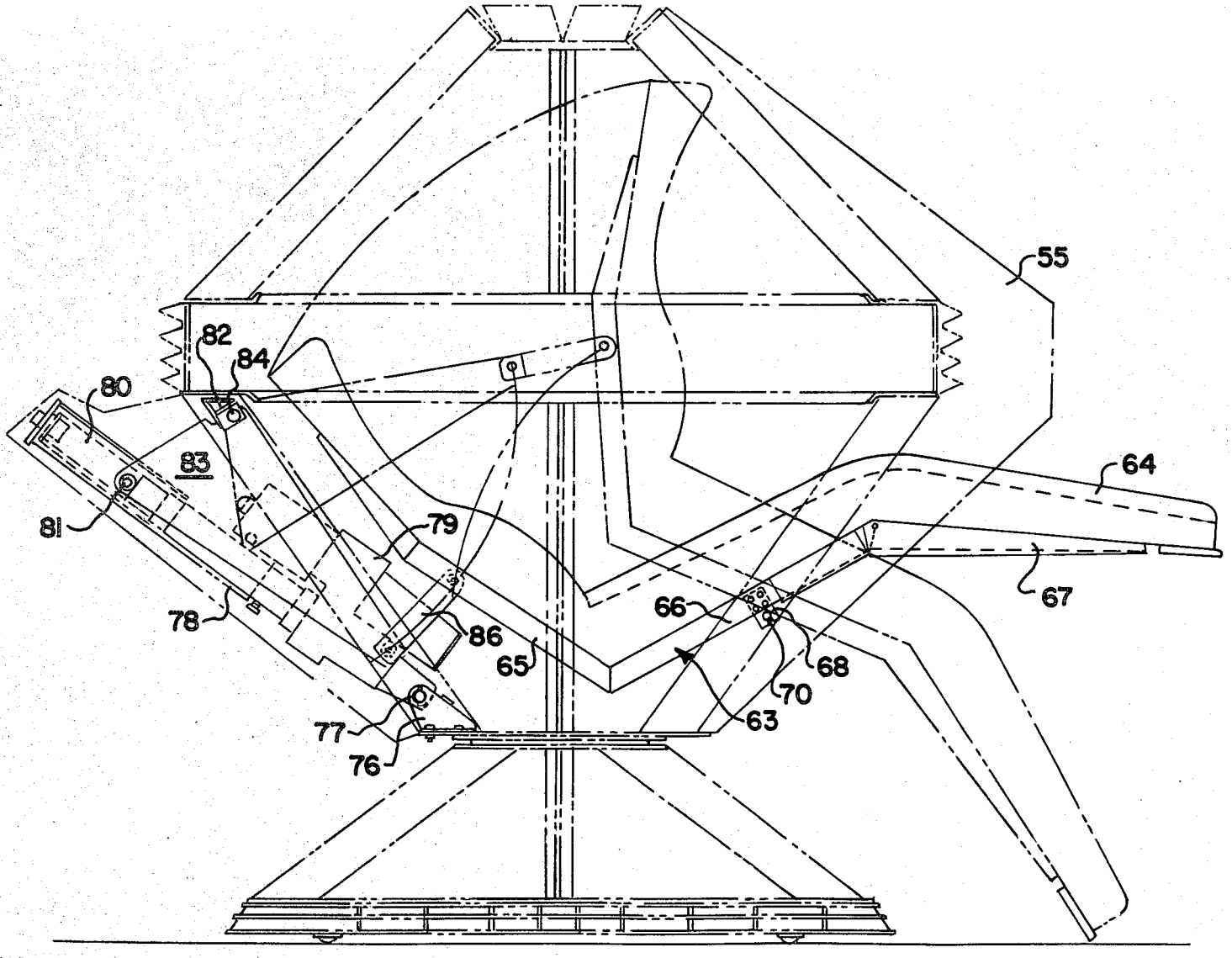
FIG. 14 is a side section illustrating the reclining seat and the actuating means therefor.

Referring now to FIG. 14, the construction of the seat is shown with the surrounding structure illustrated in phantom. The seat comprises a frame 63 with a body conforming cushion 64 secured to the top of the frame. The frame has back seat rests section 65, upper leg support section 66, and lower leg support section 67. The sections of the frame 66 are connected at obtuse angles to form one unitary structure. The frame has an open notch pivot bushing 68 secured thereto along the upper leg rest section of the frame. The bushing engages and turns upon an axle 70 fixed to the nose frame 55. The open notch pivot bushing engages the axle establishing the axis of rotation of the seat. Note that when the seat is rotated to its most upright position (shown in phantom in FIG. 14) the back rest fills the opening in the lower end of the lower leg support section and is adjacent to or abuts the floor. Note that the top edge of the back rest just clears the walls and ceiling of the enclosure as it rotates from one position to another. The back rest supports the back and shoulders but not the head and neck of a typical occupant. Thus a separate head rest is provided and will be described with reference to FIG. 16. The head rest could not rotate with the seat without binding with the interior of the enclosure.

Figure 15:
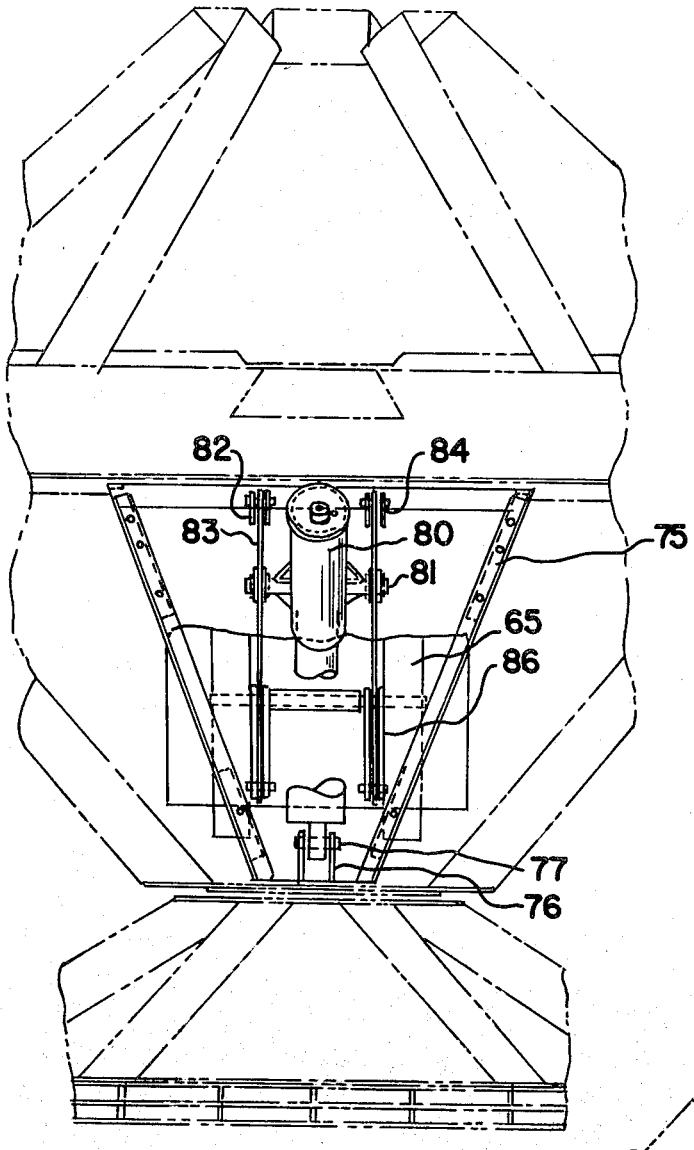
FIG. 15 is a back section illustrating the actuating means for the reclining seat.

An automatically controlled power mechanism positions the seat in its various positions between upright and reclining. The powered mechanism is supported by reinforcing structure 75 (SEE FIG. 15) mounted at its lower end to the bearing plate 38 and near its upper end to the middle weldment. Also extending from the bearing plate 38 is a clevis bracket 76. Pivotally mounted by pin 77 (journaled in the clevis bracket 76) is the lower end of the extensible mechanism 78. The extensible mechanism comprises, for example, an electric motor 79 for driving a lead screw, having an internally threaded slide member threaded thereto, which slide member is keyed to prevent rotation but is free for movement along the direction of the axis of the lead screw. Such apparatus are known in the art.

A sleeve 80 telescopes over the extensible means and at its lower end, that is the end closest to the clevis bracket 76, has short axles 81 extending from each side thereof. Thus as the extensible mechanism 78 expands, the sleeve moves away from the clevis bracket 76 carrying the short axles also away from the clevis bracket.

Fixed to the portion of the reinforcing structure 75 are two clevis brackets 82. Identical bell cranks 83 are pivotally mounted by clevis pins 84 in the clevis brackets 82. The end of the "short lever arm" of the bell cranks 83 is pivotally attached to a short axle 81 on the sleeve 80. The end of the "long lever arm" of the bell cranks 83 is pivotally mounted to one end of connecting arms 86, the other end of the connecting arms is pivotally mounted to the back rest section of the seat frame. When the extensible means is at its maximum extension, the seat is thus in the reclining position. When the extensible means is contracted, say about eight inches, the seat is moved to the upright position. For the embodiment illustrated, the point where the connecting arm 86 is pivotally mounted to the frame moves through about twenty inches and the end of the bell crank attached to the connecting arm 86 moves through about twenty-four inches. In the embodiment illustrated, the "long lever arm" of the bell cranks is about twice as long as the "short lever arm" of the bell cranks and the short and long lever arms are substantially perpendicular to each other.

Figure 16:
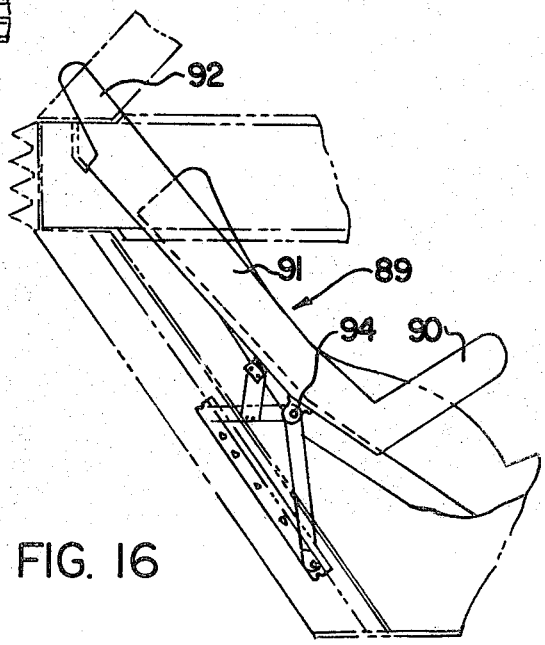
FIG. 16 details the arm and head rest.

Referring now to FIG. 16, the frame for the head and arm rest 89 is shown in detail. The head and arm rest frame comprises two arm rest sections 90, two upright sections 91 connected thereto, and a head and neck rest section 92 joining the upright section. The frame is, of course, upholstered for comfort. A tab 94 with a bore therein is secured to each upright section 91 at the back side thereof so that the entire head and arm can be pivotally mounted relative to the walls of the enclosure. The clearance between the upper edge of the back rest portion of the seat and the lower edge of the head and neck rest portion of the arm and head rest is sufficient for relative movement of the two at least when the seat is in its rearwardmost position. It is preferred that a limit switch senses when the head and arm rest is rotated to the rearwardmost position and the output of the limit switch is used to disable the automatic powered means when the head and arm rest is not at its rearwardmost position.

OPERATION

To enter the seating structure the seat is automatically rotated to the near upright position activated from a hand held ultrasonic transmitter. The person desiring to enter the seating structure can then lean into the seat while maintaining both feet on the floor. Then with someone else assisting the controls with the enclosure can be activated to rotate the seat to the reclining position. However, according to the preferred embodiment the rotation of the seat can be commenced by the occupant holding the ultrasonic transmitter. Once in the reclining position within the enclosure, the occupant has full access to control all the features of the seating structure. The procedure for exiting the seating structure is the reverse of entering except that the occupant must be sure that the head rest is rotated back away from the opening so that the limit switch sensing the head rest position will be activated.

Having thus described the invention with the detail and particularity required by the patent laws, what is desired protected by Letters Patent is set forth in the following claims.

I claim:

1. An enclosed seating structure comprising:

an enclosure having a plurality of side walls and an opening therein;

a seat pivotally mounted to said enclosure and having a portion extending through said opening;

an arm and head rest frame pivotally mounted to said side walls and arranged not to bind with said seat at least when the head rest portion is rotated back from said opening; and automatic powered means for positioning the seat in a near upright position, in a reclining position, and in positions therebetween.

2. An enclosed seating structure according to claim 1 wherein said enclosure is mounted for rotation about a vertical axis.

3. An enclosed seating structure according to claim 1 wherein said seat is dimensioned and configured such that when rotated to its upright position, the bottom end of the lower leg section touches the floor and the top end of the backrest is positioned near the top of the opening.

4. An enclosed seating structure according to claim 1 wherein said automatically powered means comprises a powered extensible device pivotally mounted at one end near the base of the enclosure, a bell crank pivotally mounted near the back of the enclosure, one leg of said bell crank pivotally mounted to the powered extensible device and the other leg pivotally connected to the seat such that when the extensible device is collapsed, the bell crank rotates forcing the seat toward its upright position.

5. An enclosed seating structure according to claim 1 wherein the means for positioning the seat is responsive to a hand-held wireless control means.

6. An enclosed seating structure according to claim 1 wherein a limit switch senses the position of the arm and head rest frame and otherwise disables the automatic powered means.

7. An enclosed seating structure comprising:

(1) an enclosure comprising a plurality of trapezoidal faces, said enclosure having a small horizontal base, a widened midsection and a small ceiling, said enclosure defining an opening extending substantially from base to ceiling, said enclosure being mounted for rotation about a vertical axis, and said enclosure including;

(a) a midsection comprising a horizontal annular disk as a base member to which are secured a plurality of identical trapezoidal frames positioned edge-to-edge and spaced to enclose a large area at their upper ends;

(b) a spacer section having generally vertical walls resting upon said upper edges of said trapezoidal frames of the midsection;

(c) a top section comprising a plurality of identical trapezoidal frames positioned edge-to-edge so as to enclose a smaller area at their upper ends;

(d) a bottom section having a flat horizontal table surface with a circular cylinder fixed thereto having a vertical axis extending upward therefrom, said annular disk of said midsection being placed around said cylinder with the lower face thereof adjacent the flat table surface of said base section;

(e) friction reducing means between said table surface and said annular disk; and (f) trapezoidal panels hung upon said frames to form an enclosure;

(2) a seat pivotally mounted on an axle that is secured across said opening, said seat extending through said opening; and (3) automatic means for positioning the seat in one position substantially blocking the opening, in a reclining position being substantially horizontal and in positions therebetwen.

8. An enclosed seating structure according to claim 7 wherein said cylinder has external threads and further comprising a collar threaded to said cylinder, said collar having an annular flange at the lower end thereof positionable adjacent the top surface of said annular disk of said midsection and friction reducing means between said annular flange and annular disk whereby said enclosure is secured to said base.

9. An enclosed seating structure according to claim 8 further comprising a driven pulley or sprocket mounted to said cylinder and concentric therewith, a motor mounted to the nose weldment having a vertical axis and having an output pulley or sprocket, belt or chain means wrapped about the driven and output pulleys or sprockets to enable the motor to pull the enclosure around the base.

10. An enclosed seating structure according to claim 8 wherein the means for positioning the seat is responsive to a hand-held wireless means.

11. An enclosed seating structure comprising:

an enclosure having a plurality of side walls and an opening therein;

a seat with a back rest, upper leg support sections connected at obtuse angles to form a unitary structure, said seat being pivotally mounted to a horizontal axle secured to the enclosure across the opening at a location along said upper leg section of the seat and said seat having a portion extending through said opening; and automatic powered means for positioning the seat in a near upright position, in a reclining position, and in positions therebetween;

said seat being dimensioned and configured such that when rotated to its upright position, the bottom end of the lower leg section touches the floor and the top end of the back rest is positioned near the top of the opening.

12. An enclosed seating structure according to claim 11 wherein said automatic powered means comprises a powered extensible device pivotally mounted at one end near the base of the enclosure, a bell crank pivotally mounted near the back of the enclosure, one leg of said bell crank pivotally mounted to the powered extensible device and the other leg pivotally connected to the seat such that when the extensible device is collapsed, the bell crank rotates forcing the seat toward its upright position.

13. An enclosed seating structure according to claim 11 wherein the means for positioning the seat is responsive to a hand-held wireless control means.

14. An enclosed seating structure according to claim 11 wherein said enclosure is mounted for rotation about a vertical axis.

* * * * *

UNITED STATES PATENT AND TRADEMARK OFFICE

CERTIFICATE OF CORRECTION

PATENT NO. : 4,470,631

DATED : September 11, 1984

INVENTOR(S) : Alfred J. Powell

It is certified that error appears in the above-identified patent and that said Letters Patent is hereby corrected as shown below:

Claim 11 - Column 8 Line 1 after "leg" insert --and lower leg--.

Signed and Sealed this

*Twenty-sixth* Day of *February 1985*

[SEAL]

*Attest:*

DONALD J. QUIGG

*Attesting Officer* *Acting Commissioner of Patents and Trademarks*